US008336235B2

(12) United States Patent
Biondan

(10) Patent No.: US 8,336,235 B2
(45) Date of Patent: Dec. 25, 2012

(54) DEVICE AND METHOD FOR FIXING COMMEMORATIVE AND SIMILAR INSCRIPTIONS

(75) Inventor: Giovanni Biondan, Montorio (IT)

(73) Assignee: Biondan S.p.A., Montorio (IT)

( * ) Notice: Subject to any disclaimer, the term of this patent is extended or adjusted under 35 U.S.C. 154(b) by 0 days.

(21) Appl. No.: 13/022,380

(22) Filed: Feb. 7, 2011

(65) Prior Publication Data

US 2011/0192063 A1 Aug. 11, 2011

Related U.S. Application Data

(63) Continuation-in-part of application No. 12/201,755, filed on Aug. 29, 2008, now abandoned.

(30) Foreign Application Priority Data

Jun. 30, 2008 (IT) ..... VR2008A0077

(51) Int. Cl.
*G09F 1/12* (2006.01)

(52) U.S. Cl. ..... 40/124.5; 40/606.01; 40/617

(58) Field of Classification Search ..... 248/475.1; 40/661.01, 781, 661.05, 517, 620, 622
See application file for complete search history.

(56) References Cited

U.S. PATENT DOCUMENTS 3,119,371 A * 1/1964 Zuckerman ..... 119/258
3,709,456 A * 1/1973 Pietsch ..... 248/475.1
5,671,097 A * 9/1997 Merriweather, Jr. ..... 359/871
6,199,327 B1 3/2001 Krawczyk

* cited by examiner

*Primary Examiner* — Casandra Davis
(74) *Attorney, Agent, or Firm* — Tutunjian & Bitetto, P.C.

(57) ABSTRACT

A device (1) and a method for fixing commemorative inscriptions, such as, for example, words, photographs, patterns, symbols and the like, and/or cinerary urns, to be applied to headstones, front coverings of crypts and the like, include a surround (2) and an inner frame (3) which may be fixed to a headstone or a wall (4), the inner frame (3) cooperates with the surround (2) by connection device (5, 6, 15, 16). An indicator block (7) provided with commemorative inscriptions (8) is inserted and locked inside the surround (2), and the connection elements include hidden anchoring parts (5, 6) completely enclosed inside the surround (2).

23 Claims, 8 Drawing Sheets

DEVICE AND METHOD FOR FIXING COMMEMORATIVE AND SIMILAR INSCRIPTIONS

CROSS-REFERENCE TO RELATED APPLICATIONS

This is a continuation-in-part of application Ser. No. 12/201,755 filed Aug. 29, 2008 and which is currently pending, the disclosure of which is incorporated herein by reference.

TECHNICAL FIELD

This invention relates to a device and a method for fixing commemorative inscriptions, such as, for example, photographs, patterns, symbols, words and the like to be applied to headstones, front coverings of crypts, etc.

RELATED ART

Commemorative inscriptions include photographs, patterns, symbols and words of every type, are widely used for headstones or for the covering walls of crypts.

Traditionally, the inscriptions on the headstones are realized by directly engraving the headstone material, which may be, for example, marble or other similar stone. Alternatively, the individual letters in the case of words, or the reproductions, patterns, and photographs may be glued or fixed by other means to the headstone.

These methods of realization or application of inscriptions are quite laborious and expensive due to the labor required and the need has therefore arisen to provide more inexpensive devices or methods for the application of commemorative inscriptions on headstones and the like.

U.S. Pat. No. 6,199,327 B1 describes a commemorative plaque to be applied in a removable manner to the front part of a headstone or the front covering of a crypt.

The plaque comprises an indicator block, a metal surround, with a hollow rear part, which is able to hold and protect the indicator block and a three-armed bracket.

The indicator block is in turn fixed by screws to the surround in order to form a single combination with the surround itself.

The surround-indicator block combination also comprises a plate fixed with screws to the upper part of the surround and placed at a certain distance from the rear face of the indicator block in order to form an elongated seat in which it is possible to insert the upper arms of the bracket which in turn is fixed to the headstone by means of two anchor bolts.

The surround-indicator block combination is hung from the upper arms of the bracket which fits into the space between the rear face of the indicator block and the upper plate, making the surround slide along the headstone.

The surround is then blocked by a screw fitted in the lower side face of the surround. The single screw is inserted in a threaded hole at the end of the bracket's lower arm.

The plaque according to U.S. Pat. No. 6,199,327 B1 is quite a complex construction comprising several parts fixed together with screws.

If each of the parts forming the plaque of U.S. Pat. No. 6,199,327 B1 is not fully tightened and locked against spontaneous unscrewing, it is possible for some parts of the plaque and in particular the surround to accidentally detach themselves.

In turn, the surround may also cause the detachment of the bracket from the headstone since the bracket itself is fixed only with two screws, whilst the surround, comprising also the indicator block, may be quite heavy, especially if the indicator block is made from marble or other similar stone.

In addition, since the bracket is formed with three arms it lies behind the indicator block and increases the overall thickness of the plaque.

SUMMARY

An aim of this invention is to improve the prior art. Another aim of this invention is to provide a device and a method for fixing commemorative inscriptions and/or cinerary urns which is easy to produce.

A further aim of this invention is to provide a method for fixing commemorative inscriptions which is inexpensive to produce and easy to use.

An additional aim of this invention is to provide a device and a method for fixing commemorative inscriptions and/or cinerary urns which enables safe assembly and disassembly, without the risk of accidental falling of any parts.

Yet another aim of this invention is provide a device and a method for fixing commemorative inscriptions and/or cinerary urns which is strong and can support heavy indicator blocks.

A further aim of this invention is to provide a device and a method for fixing commemorative inscriptions and/or cinerary urns which can be easily applied to headstones or covering walls of crypts and which has a limited thickness.

A device for fixing commemorative inscriptions and/or cinerary urns according to a preferred embodiment of the invention is provided in claim 1.

A device for fixing commemorative inscriptions and/or cinerary urns to a headstone or a wall according to another preferred embodiment of the invention is provided in independent claim 23.

The dependent claims refer to preferred and advantageous embodiments of the invention.

BRIEF DESCRIPTION OF THE DRAWINGS

Other characteristics and advantages of the invention are more apparent from the detailed description which follows, with reference to the accompanying figures which illustrate a preferred embodiment of a device for fixing commemorative inscriptions and/or cinerary urns provided merely by way of example without restricting the scope of the inventive concept, and in which.

DESCRIPTION OF THE PREFERRED EMBODIMENTS

Figure 1:
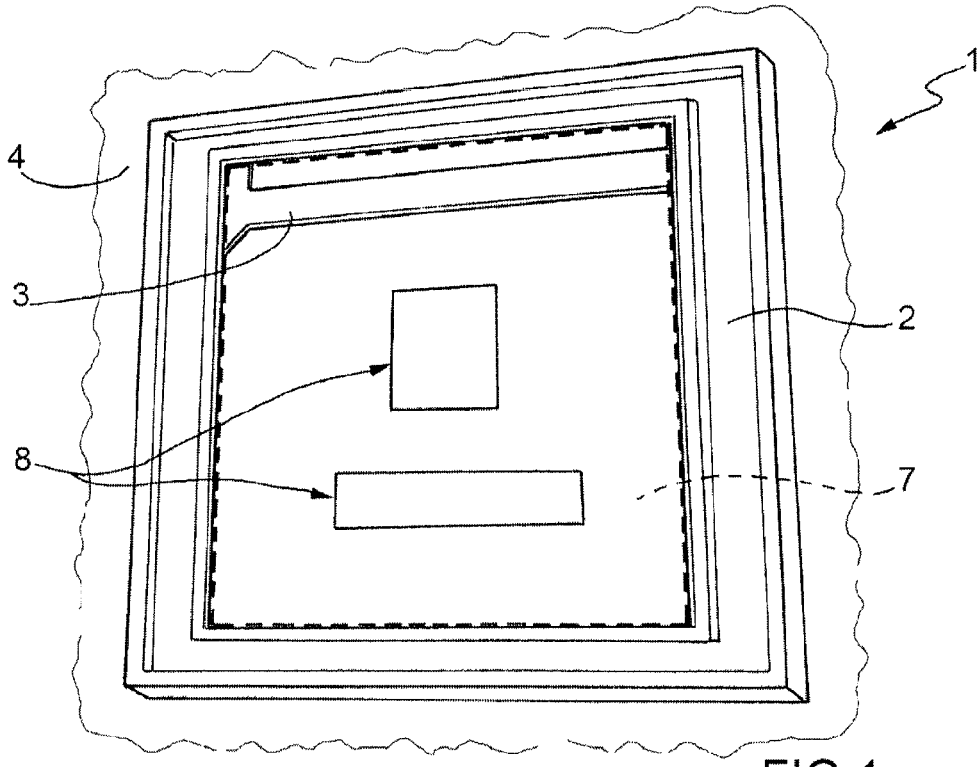
FIG. 1 is a front view of a device for fixing commemorative inscriptions and/or cinerary urns.

With reference to the accompanying figures, the numeral 1 denotes in its entirety a device for fixing commemorative inscriptions according to a version of the invention, which comprises basically an outer surround 2, an inner frame 3 fitted inside the surround 2 and associated to the latter by connection means 5, 6, 15, 16 and an indicator block 7 fitted, on the exposed face, with commemorative inscriptions 8, schematically shown in the figures by rectangles.

For the purpose of this invention, the term inscriptions and the schematization with rectangles in the figures can comprise words of any type and size, as well as patterns, symbols, photographs, reproductions, supports for lights, vases, etc.

Figure 3:
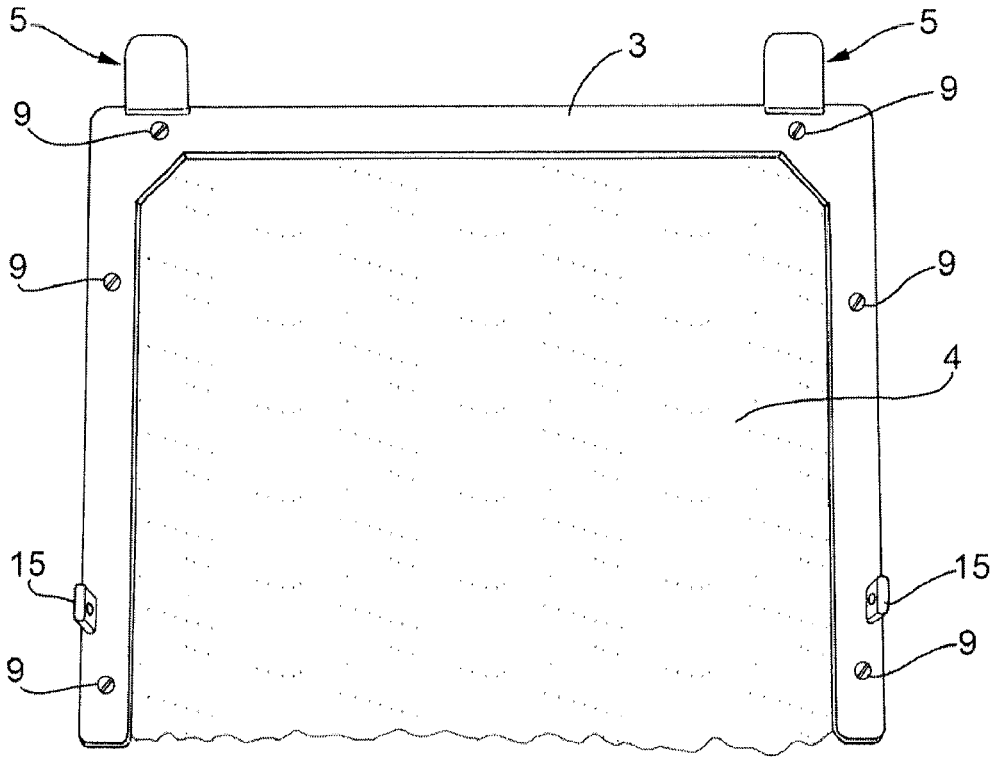
FIG. 3 is a front view of a detail of the device in the previous figures.
Figure 5:
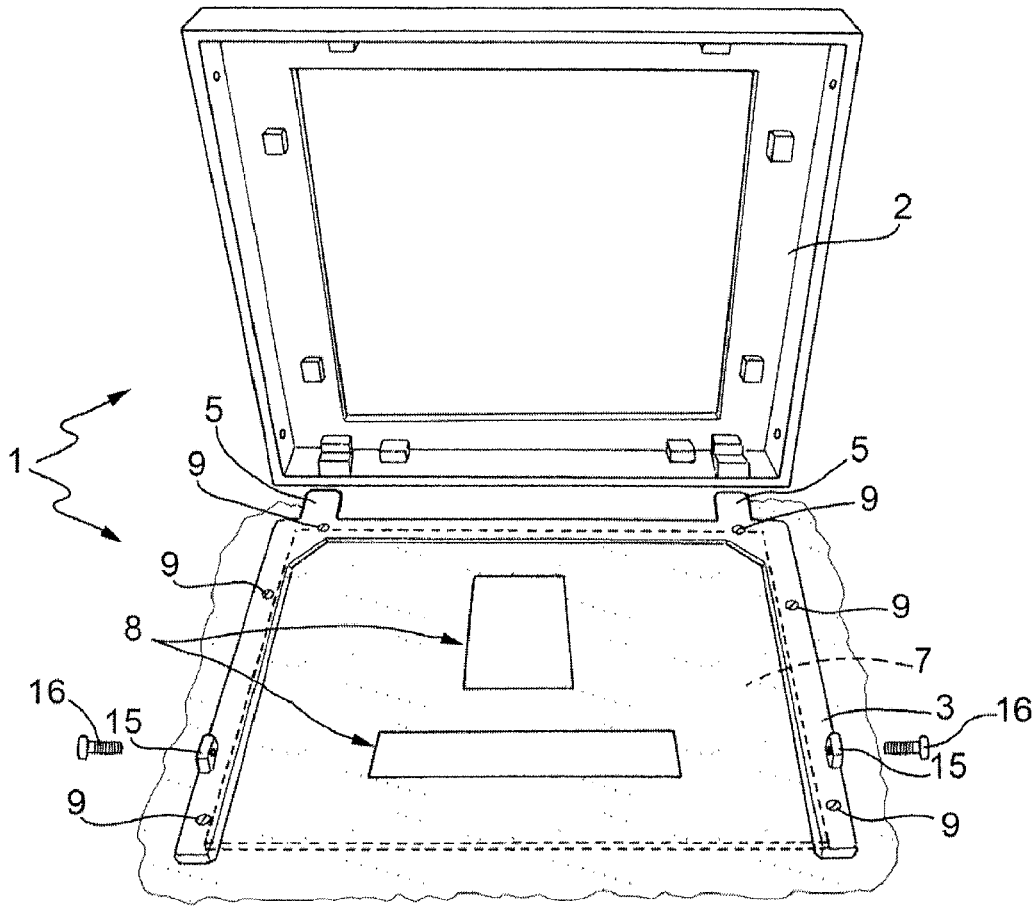
FIG. 5 is a view of an assembly step of some components of the device in the previous figures.
Figure 6:
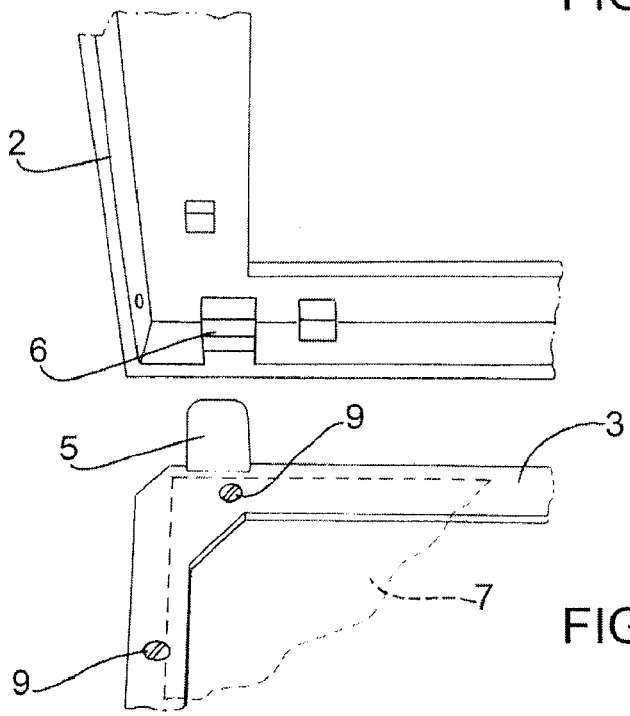
FIG. 6 is an enlarged view of a detail of the components of the device of FIG. 5.

As illustrated in particular in FIGS. 3 and 5, the inner frame 3 is fixed, by fixing means 9, to a headstone or a wall 4, for example a covering wall of crypts or niches.

The above-mentioned fixing means 9 comprise a plurality of connection means, which may be realized by screws and expansion plugs fitted in special holes provided in the wall 4, or by other equivalent connection means.

The fixing means 9 are distributed uniformly along the inner frame 3 to distribute in an optimum manner the load deriving from the surround 2 and from the indicator block 7.

In the case of a rectangular surround as illustrated in the figures, the inner frame 3 has the approximate shape of an inverted "U", that is to say, a structure formed by three approximately flat elements, placed substantially perpendicular to each other and connected together.

By way of an example, but without restricting the scope of the invention, the indicator block 7 may have a thickness of approximately one centimeter, whilst the surround 2 may have a thickness of approximately 2 to 3 centimeters, thereby providing a very small overall thickness even though it can be dismantled.

The inner frame 3, which can be manufactured by a die casting, pressing or welding process, has a thickness such as to provide sufficient resistance to the load deriving from the surround 2 and the indicator block 7.

The surround 2 has rear border 10 which therefore rests completely on the wall 4.

As illustrated in detail in FIG. 5, the inner frame 3 surrounds the indicator block 7 and, as it is not behind the indicator block, does not increase the overall size.

In particular, the shape of the inner frame 3 is complementary to the shape of the indicator block 7 which must be inserted inside the perimeter of the surround 2 and may have different shapes.

The surround 2, which may be realized by a casting, die-casting or pressing process, has a rectangular shape in the embodiment illustrated in the figures, but may have any other shape, for example, polygonal, oval, circular, etc.

The inner frame 3 and the surround 2 may be made from corrosion resistant metal and, for example, may be made from bronze, brass or stainless steel.

Figure 4:
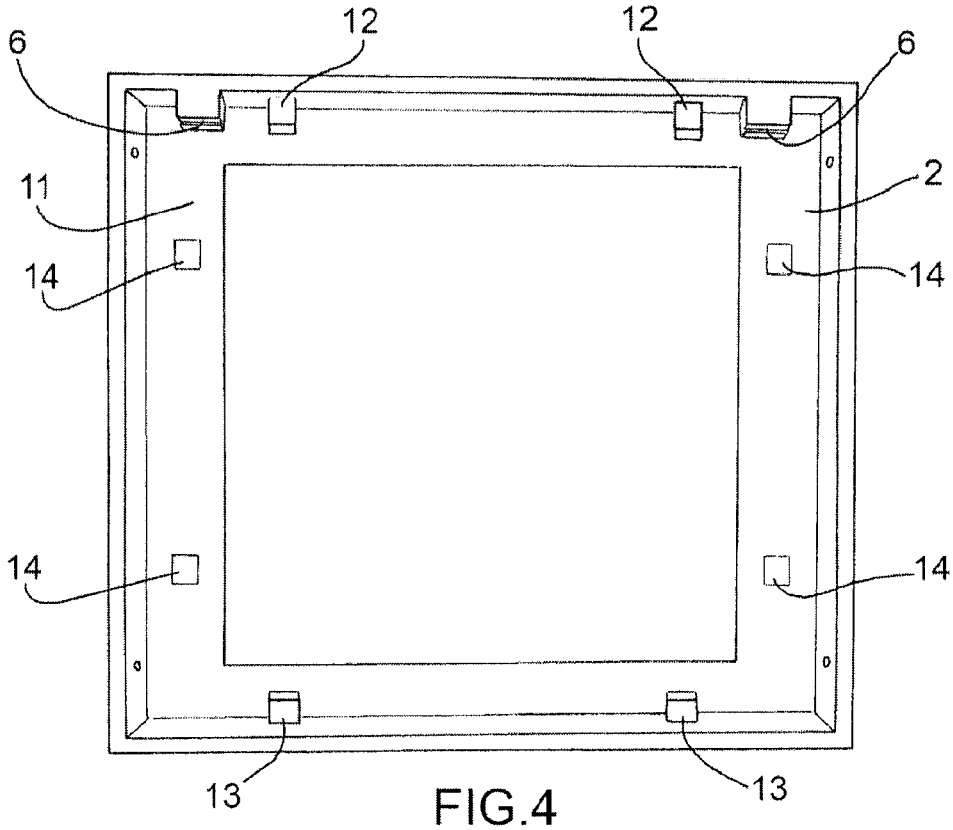
FIG. 4 is a rear view of the surround of the device in the previous figures.

As illustrated in more detail in FIG. 4, the surround 2 has an inner surface 11 comprising upper supports 12 and lower supports 13 positioned on the upper and lower inner borders of the surround, and lateral blocks 14 placed on the lateral inner borders of the surround 2.

The above-mentioned supports 12, 13 and lateral blocks 14 act as a support and reference for the indicator block 7 in a vertical and lateral direction with respect to surround 2.

As illustrated in FIGS. 7 to 11, the indicator block 7 is fixed to the surround by plates 17 and screws 18 screwed into the rear part of the surround.

Figure 11:
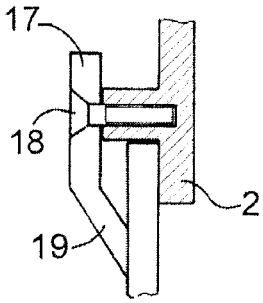

FIG. 11 illustrates a variant of the plate 17 comprising a flexible, inclined portion 19.

By bending the above-mentioned inclined portion 19, this plate 17 may be adapted to blocks 7 of different thicknesses.

Figure 17:
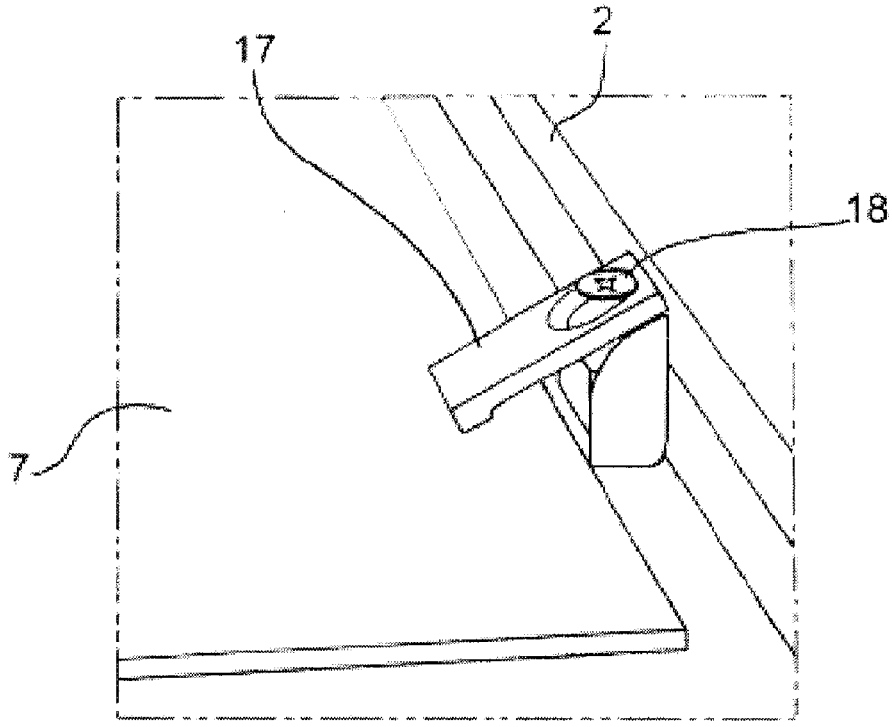
FIG. 17 is view of a detail of the components of the present invention.

FIG. 17 illustrates another variant of the plate 17, being inclined with respect to indicator block 7 and to the surround 2, and being fixed through screws 18.

The inner frame 3 also comprises lateral lugs 15 for fixing the surround 2 to the frame 3.

As illustrated in detail in FIGS. 3 to 6, the connection means, provided for the assembly of the surround 2 on the frame 3, comprise jointing means of the hidden type.

In the embodiment illustrated in the figures, the jointing means comprise the protrusions 5 fitted on the inner frame 3 and the housings 6 fitted on the surround 2.

The housings 6 are complementary to the protrusions 5 and enable insertion of the above-mentioned protrusions 5, and they have dimensions such as to prevent, in particular, detachment movements of the surround 2 perpendicular to the wall 4.

The housings 6 may be obtained by means of mechanical machining, for example by grinding or similar machining, or they may be obtained directly by the casting, die-casting or pressing processes.

The protrusions 5 can have different shapes and have a flat plate shape as illustrated in the figures, or can have the shape of a pin or prismatic element, etc. Naturally, the housing 6, which is complementary to the protrusion 5, will consequently have a cylindrical, prismatic shape, etc.

Since the jointing means, that is to say, the protrusions 5, of which there are, specifically, two, are formed in the upper part of the inner frame 3, as are the housings 6 of the surround 2, the surround 2 itself is practically hung from and supported by the inner frame 3.

For the full fixing of the surround 2 to the frame 3, the connection means comprise means of anchoring to the lugs 15 within which the anchoring device of the removable type is inserted. The anchoring device may be realized for example by means of screws 16 screwed in the lateral border of the surround 2. The end of the screws 16 protruding on the inner side of the border of the surround 2 enter special holes provided in the lateral lugs 15, thereby realizing the full anchoring of the surround 2 to the inner frame 3.

Whatever the case, the anchoring means may comprise any type of matchable and removable jointing means such as, for example, pins, nails, rivets, etc., to be inserted in special holes or seats provided on the inner frame 3.

The anchoring means 15, 16 lie in the lower part of the surround 2 and the inner frame 3 since the jointing means 5, 6 lie in the upper part of the surround. In this way, the surround 2 is completely fixed to the inner frame 3 above and below.

Figure 2:
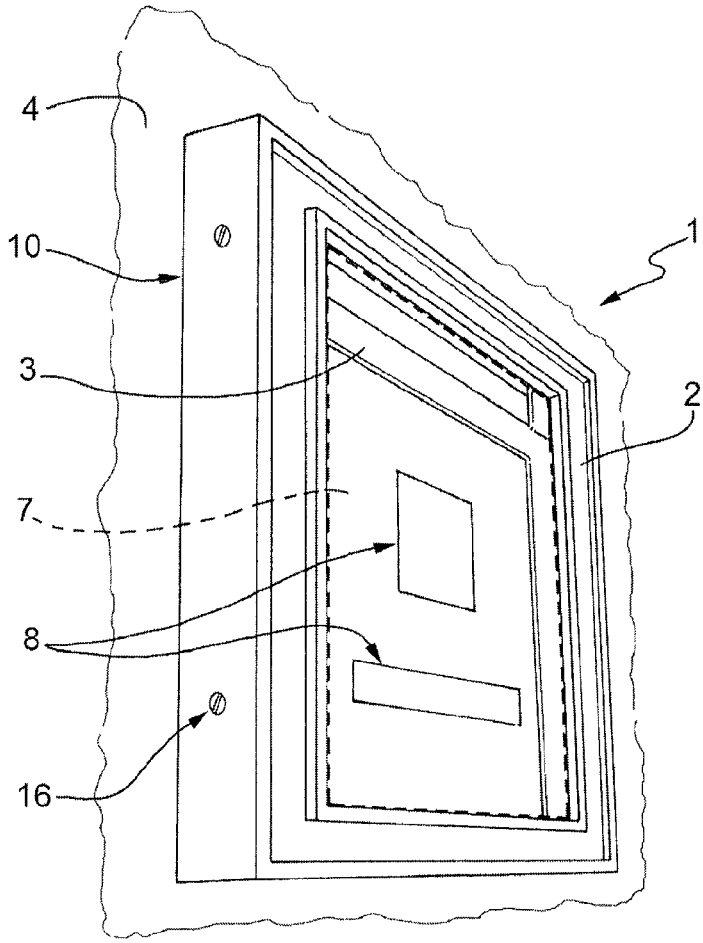
FIG. 2 is a perspective side view of the device in FIG. 1.

As illustrated in more detail in FIG. 2, the head of the screw 16 is inserted in a special seat so that it is in line with the border of surround 2 and it is accessible on the outer side of the border of the surround 2 to disassemble or fix the surround 2 from or to the inner frame 3.

Figure 16:
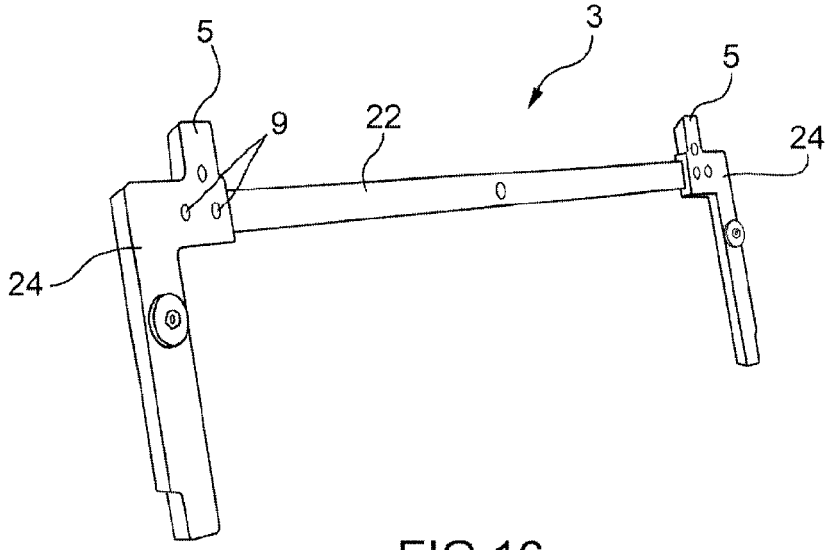
FIG. 16 is a perspective view of a version of an inner frame of the present invention according to another embodiment.
Figure 18:
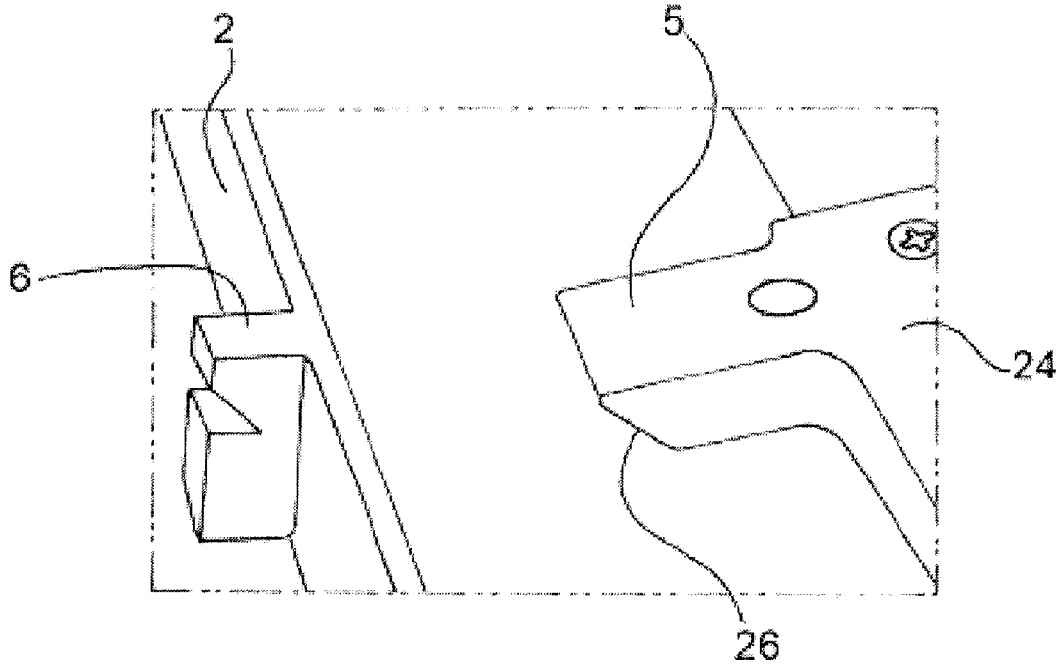
FIG. 18 is an enlarged view of a particular of a detail of FIG. 16.

In a version of the invention illustrated in FIGS. 16 and 18, the approximately flat elements of the inner frame 3 may comprise, e.g., three separate flat elements to be connected together in order to form the approximate shape of an inverted "U".

In particular, in this version, the inner frame 3 comprises a substantially horizontal flat element 22 and two substantially vertical flat elements 24. The substantially horizontal flat element 22 may be adjusted in length, as to have the possibility to be adapted to different surrounds 2 of various dimensions.

The substantially horizontal flat element 22 has not a support function but only a reference function for the distance and the position of the inner frame 3 and/or for the substantially vertical flat elements 24. Therefore, the thickness of the substantially horizontal flat element 22 can be very small.

The indicator block 7 is surrounded by the inner frame 3 but it can also be positioned in front and on the substantially horizontal flat element 22. In this way, thanks to the small thickness of the substantially horizontal flat element 22, also if the indicator block 7 lies upon the element 22, the overall size of the device of the present invention is not increased.

The substantially vertical flat elements 24 are the supporting element of the inner frame 3. They comprise, in their upper part, each a protrusion 5.

In a version of the invention, the substantially horizontal flat element 22 is not present.

The three approximately flat elements 22, 24 could be fixed together by fixing means 9, of the type indicated above.

Figure 19:
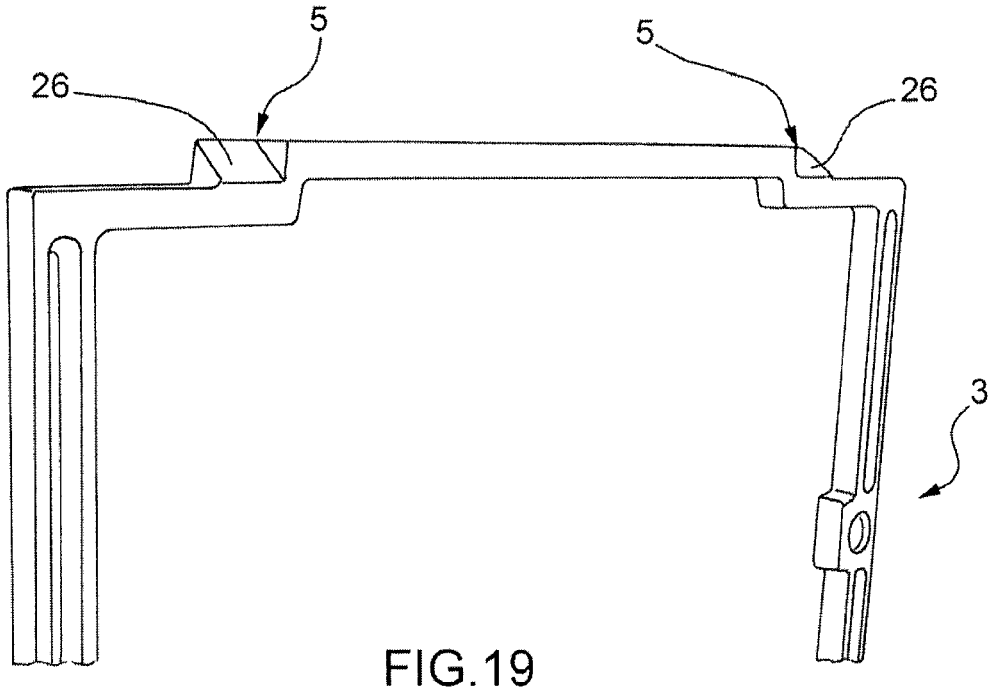
FIG. 19 is a front view of the inner frame of FIG. 16 of the present invention.

In a further version of invention, the inner frame 3 and protrusions 5 are realized in a single monolithic piece, as illustrated in FIG. 19.

Figure 7:
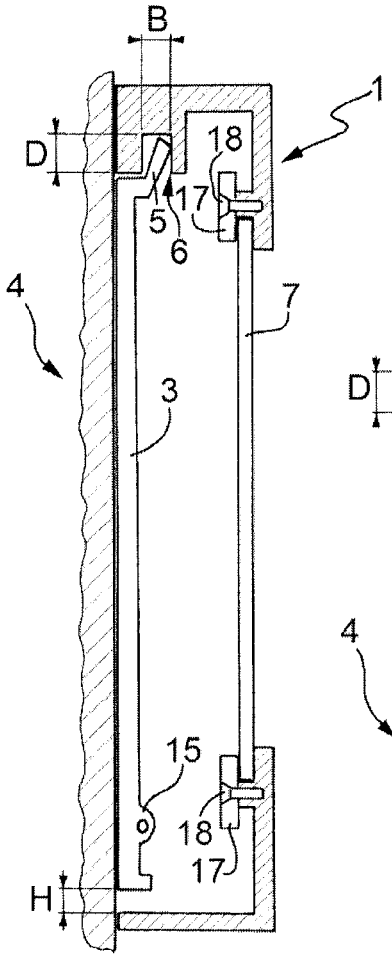
FIGS. 7 to 9 illustrate the disassembly sequence of some components of the device in the previous figures.
Figure 8:
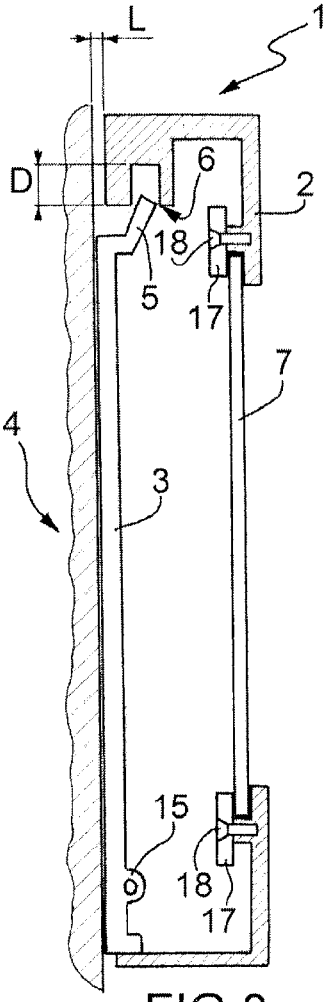
Figure 9:
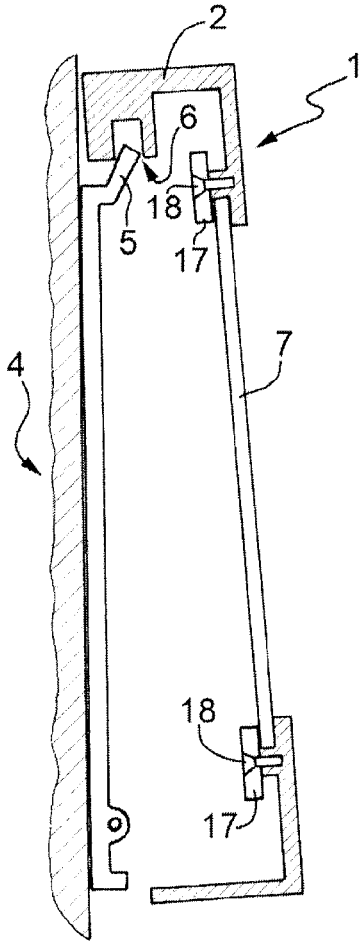

FIGS. 7 to 9 illustrate a disassembly sequence of the surround 2 from the inner frame 3.

In FIG. 7 the surround 2 is still fitted and it is completely resting on the wall 4, and it can be seen that the lower inner end of the surround 2 lies at a specific distance, indicated with "H", from the lower end of the inner frame 3.

In FIG. 8 the surround 2 is raised until it brings the lower inner end of the surround 2 to rest on the lower end of the inner frame 3 thus reducing the distance "H" to zero.

It can also be seen that, on the top, the surround 2 is still anchored to the protrusions 5 by the housings 6, since the housings 6 have a depth "D" which is greater than the distance "H".

Therefore, even during the disassembly, the accidental falling of the surround 2 is prevented, and in particular the accidental detachment of the surround 2 from the protrusions 5 is prevented.

In addition, in the version illustrated in FIGS. 7 to 9, the protrusions 5 are facing upwards and are slightly inclined away from the wall 4, in order to guide the surround 2 outwards, by means of the housings 6.

The housings 6 can also be inclined like the protrusions 5 (version not shown here) and present an opportune clearance to enable a relative movement between housings 6 and protrusions 5, or the housings 6 can have a length "B" which enables the protrusions 5 to be received even if inclined (FIGS. 7-9).

As can be seen in particular in FIG. 8, the upper part of the surround 2 therefore lies at a distance "L" from the wall 4. Thanks to this, the surround 2 may be inclined without interfering with the wall 4 and permitting the complete disassembly of the surround 2 from the frame 3, as illustrated in FIG. 9.

Figure 10:
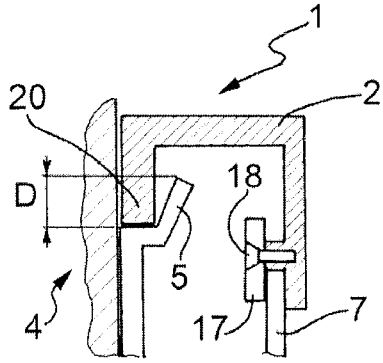
FIGS. 10 and 11 illustrate some enlarged details of the device in the previous figures.

FIG. 10 illustrates a simplified version of the surround 2, in which there are two appendages 20 in place of the housings 6, and it is still possible with this version to incline the surround for the complete disassembly since the protrusion 5 is inclined and enables the appendages 20 to rotate.

Also with this simplified version the appendages 20 fit into the protrusions 5 for a section "D" greater than the distance "H" and there is still therefore the same protection against accidental falling of the surround 2, preventing the surround 2 from accidentally detaching itself from the protrusions 5.

FIGS. 12 to 15 illustrate a disassembly sequence of the surround 2 from the inner frame 3 when the projections 5 have a planar surface 26 facing upwards and inclined away from the wall 4. That is, in this embodiment, the projections 5 are configured at an angle pointing away from the wall 4.

Figure 12:
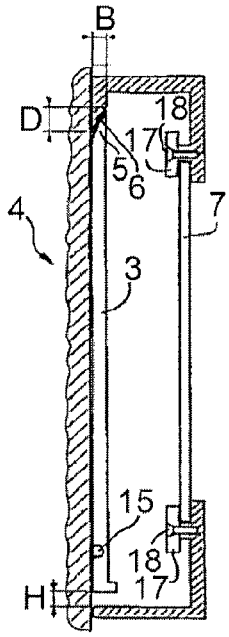
FIGS. 12 to 15 illustrate the disassembly sequence of some components of a device of the present invention according to another embodiment.

In FIG. 12 the surround 2 is still fitted and it is completely resting on the wall 4, and it can be seen that the lower inner end of the surround 2 lies at a specific distance, indicated with "H", from the lower end of the inner frame 3.

Figure 13:
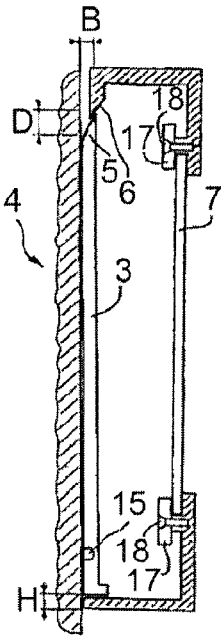

In FIG. 13 the surround 2 is raised until it brings the lower inner end of the surround 2 to rest on the lower end of the inner frame 3 thus reducing the distance "H" to zero.

It can also be seen that, on the top, the surround 2 is still anchored to the protrusions 5 by the housings or appendages 6, since the housings or appendages 6 have a depth "D" which is greater than the distance "H".

Therefore, even during the disassembly, the accidental falling of the surround 2 is prevented, and in particular the accidental detachment of the surround 2 from the protrusions 5 is prevented.

In addition, in the version illustrated in FIGS. 12 to 15, the protrusions 5 have a planar surface 26 facing upwards and slightly inclined away from the wall 4, in order to guide the surround 2 outwards, by means of the housings or appendages 6.

The housings or appendages 6 can also be inclined like the protrusions 5 and present an opportune clearance to enable a relative movement between housings or appendages 6 and protrusions 5, or the housings or appendages 6 can have a length "B" which enables the protrusions 5 to be impeded to exit even if inclined (FIGS. 12-15).

Figure 14:
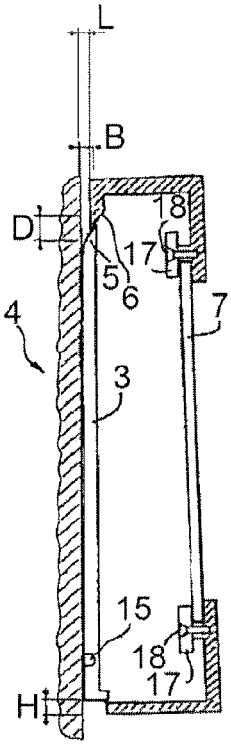
Figure 15:
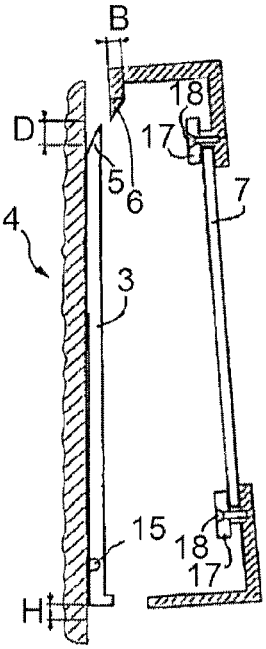

As can be seen in particular in FIG. 14, thanks to the planar surface 26, the surround 2 may be inclined for a distance "L" from the wall 4 without interfering with the wall 4 and permitting the complete disassembly of the surround 2 from the frame 3, as illustrated in FIG. 15.

In a version of the invention, showed in FIGS. 16, 18 and 19, the protrusions 5 have a planar surface 26 that allow the above-explained safe and easy way of disassembly the surround 2 from the inner frame 3. Also in this case, the housings 6 have a shape that is correspondent to the planar surface 26 of the protrusions 5.

Figure 20:
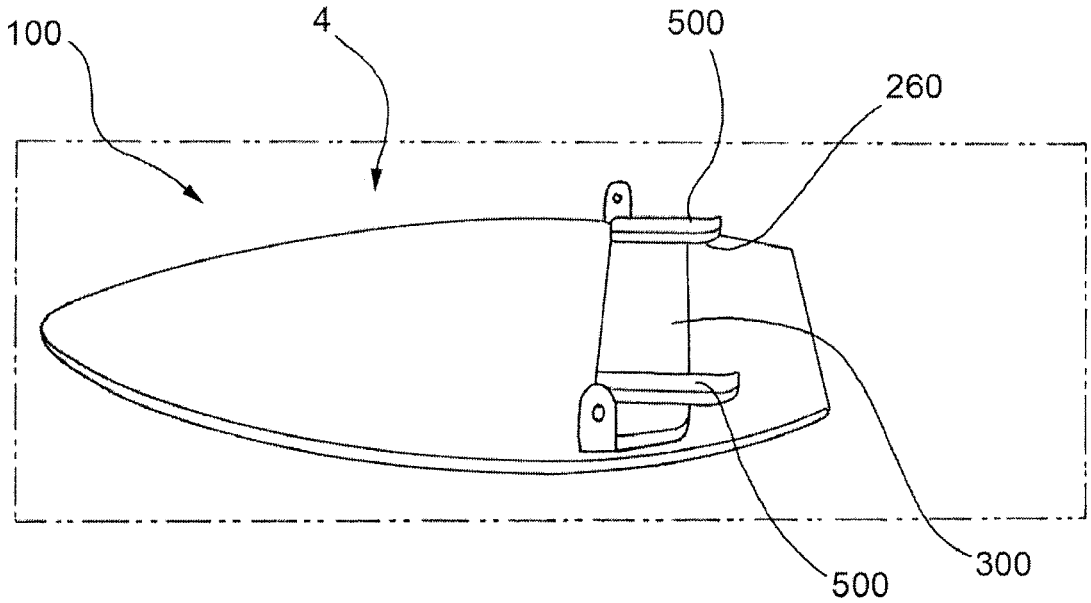
FIG. 20 is a perspective view of a version of the present invention.
Figure 21:
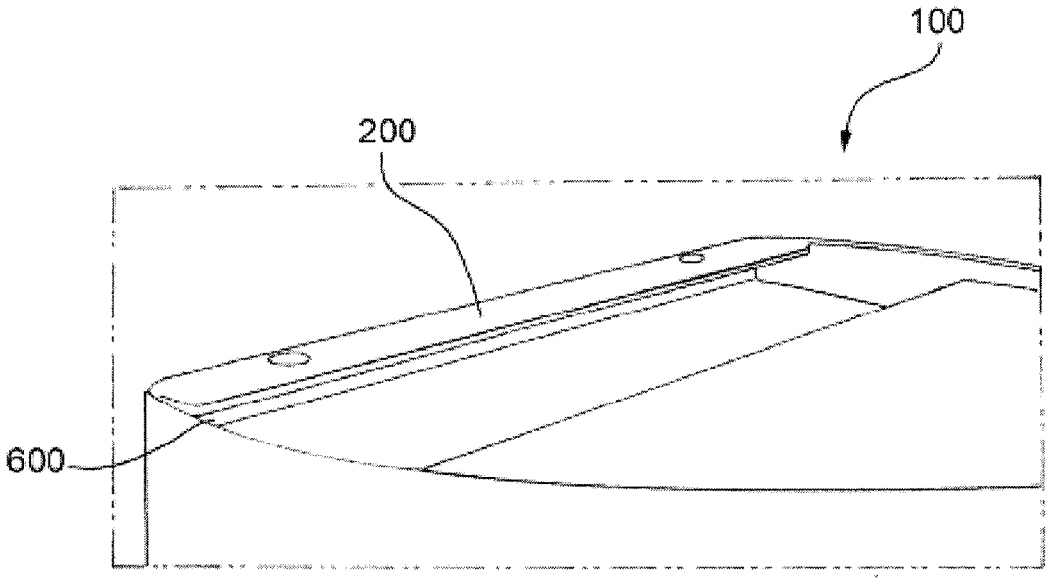
FIG. 21 is a further component of the version of FIG. 20.

In a further version of the invention, as illustrated in FIGS. 20 and 21, the numeral 100 denotes in its entirety a device for fixing cinerary urns, according to an embodiment of the present invention.

All aspects that are the same with respect to the previous versions are indicated with the same reference numbers increased by increments of 100.

The device 100 comprises an inner frame 300. The inner frame 300 is substantially rectilinear but all shapes suitable for the above-mentioned functions are possible. The inner frame 300 may include lateral lugs 15.

The inner frame 300 comprises projections 500; projections 500 are inclined away from the headstone or wall 4 or urn support. In a version of the invention, the projections 500 have a planar surface 260.

The projections 500 can be fitted inside respective housings 600, of a complementary shape with respect to the projections 500. The housings 600 could be placed in the cinerary urn surround 200 that is therefore supported and hung by the projections 500.

With this invention it is therefore possible to fix in a simple and safe manner the commemorative inscription and/or a cinerary urn to a headstone or to a wall.

The fixing is perfectly reversible and it is therefore possible to use the device according to this invention on different headstones or walls even several times.

The entire fixing and indicator block system is completely housed inside the surround and is therefore protected and the surround is also resting completely on the headstone or wall.

The connection between the outer surround and the inner frame is achieved with jointing means of a very strong type completely enclosed inside the surround itself.

The relative dimensions of the protrusions 5, 500 and the housings 6, 600 enable the disassembly and the assembly of the surround 2 from and to the inner frame 3 always in a safe manner.

Thanks to the extent of the connection means 9 on the wall, the fixing is safe and even able to support heavy loads. The surround and the fixing frame may have different shapes: polygonal, oval, circular shapes etc. are possible in addition to the rectangular shape illustrated.

The invention claimed is:

1. A device for fixing at least one of commemorative inscriptions and cinerary urns comprising a surround, an inner frame which can be fixed to a headstone or a wall, the inner frame being associated with the surround by connection means, an indicator block provided with commemorative inscriptions and/or a cinerary urn associated with the surround, wherein the connection means comprises jointing means completely enclosed inside the surround and wherein the jointing means comprises protrusions each having a planar surface facing upwards, inclined away from the wall and fitted on the frame, and housings or appendages fitted on the surround, further comprising wherein the housings or appendages have a depth D, wherein when the surround is fitted onto the inner frame, a lower inner end of the surround lies at a distance H from a lower end of the inner frame, wherein the depth D is greater than the distance H.

2. The device according to claim 1, wherein the connection means comprises anchoring means.

3. The device according to claim 2, wherein the anchoring means are completely enclosed in the surround wherein the connection means are hidden from the surround.

4. The device according to claim 3, wherein the anchoring means comprises lugs and an anchoring device.

5. The device according to claim 4, wherein the anchoring device is associated with the surround and is inserted in special holes or housings provided in the lugs, thereby realizing full anchoring of the surround to the frame.

6. The device according to claim 5, wherein the anchoring device comprises screws screwed into the surround and inserted in special holes or housings provided in the inner frame.

7. The device according to claim 4, wherein the lugs and the anchoring device are fitted in a lower part of the inner frame and the surround.

8. The device according to claim 1, wherein the jointing means is fitted in an upper part of the inner frame and the surround.

9. The device according to claim 1, wherein the surround has an inner surface comprising upper supports and lower supports, positioned on upper and lower inner edges of the surround, and lateral blocks placed on inner lateral edges of the surround, the supports and the lateral blocks serving as support and reference for the indicator block in a vertical and lateral direction with respect to the surround.

10. The device according to claim 9, wherein the supports and the lateral blocks comprise plates for fixing the indicator block, the plates comprising a flexible inclined portion to fix blocks of different thicknesses.

11. The device according to claim 1, wherein the protrusions insert in housings or appendages of the surround, in order that, during disassembly of the surround, the protrusions guide the surround away from the wall at least for a distance "L", in order that the surround may be inclined without interfering with the wall.

12. The device according to claim 1, wherein an inner lower end of the surround lies at a distance "H" from a lower end of the inner frame.

13. The device according to claim 12, wherein protrusions insert into housings or appendages for a depth "D" which is greater than the distance "H".

14. The device according to claim 1, wherein the inner frame is fixed to the headstone, or to the wall, by fixing means.

15. The device according to claim 14, wherein the fixing means comprises a plurality of connection means.

16. The device according to claim 15, wherein the connection means comprises screws fitted in special holes provided in the wall.

17. The device according to claim 1, wherein a shape of the surround includes at least one of a rectangle, square, polygon, oval and circle.

18. The device according to claim 1, wherein the inner frame has a complementary shape to the shape of the indicator block and/or of the cinerary urn and the surround.

19. The device according to claim 1, wherein the inner frame has an approximate shape of an inverted "U" forming a structure formed by approximately flat elements, placed substantially perpendicular to each other, connected together or forming single approximately flat elements.

20. The device according to claim 1, wherein the inner frame surrounds the indicator block and/or the cinerary urn and wherein the indicator block and/or the cinerary urn is inside a perimeter of the inner frame.

21. The device according to claim 1, wherein the surround comprises a hollow part and wherein the inner frame and the indicator block are completely inside the hollow part of the surround inside a thickness of the surround itself.

22. A method for fixing commemorative inscriptions and/or cinerary urns to a headstone or a wall, comprising the steps of:

providing a surround, an inner frame, an indicator block fitted with commemorative inscriptions and/or the cinerary urn;

fixing the inner frame to the wall;

associating the indicator block and/or the cinerary urn to the surround;

connecting the surround to the inner frame by connection means;

wherein the step for connecting the surround to the inner frame comprises a step for fixing the surround to the inner frame by connection means completely enclosed inside the surround wherein the connection means is hidden by the surround, wherein the connection means includes jointing means comprising protrusions each having a planar surface facing upwards, inclined away from the wall and fitted on the frame and housings or appendages fitted on the surround, wherein the housings or appendages have a depth D, wherein the surround is connected to the inner frame, a lower inner end of the surround lies at a distance H from a lower end of the inner frame, wherein the depth D is greater than the distance H.

23. A method for fixing according to claim 22, wherein the step for connecting the surround to the inner frame comprises an anchoring step by hidden anchoring means which are completely enclosed inside the surround.

* * * * *